US006648469B2

(12) United States Patent
Youn

(10) Patent No.: US 6,648,469 B2
(45) Date of Patent: Nov. 18, 2003

(54) PAPER-DISCHARGING SYSTEM AND METHOD IN AN INKJET PRINTER

(75) Inventor: Karp-sik Youn, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/160,112

(22) Filed: Jun. 4, 2002

(65) Prior Publication Data

US 2003/0085976 A1 May 8, 2003

(30) Foreign Application Priority Data

Nov. 6, 2001 (KR) ..... 2001-68735

(51) Int. Cl.[7] ..... B41J 2/01
(52) U.S. Cl. ..... 347/104
(58) Field of Search ..... 347/102, 104; 271/188, 277; 400/611, 624, 629

(56) References Cited

U.S. PATENT DOCUMENTS 5,931,589 A * 8/1999 Kamano et al. ..... 347/104
6,398,352 B1 * 6/2002 Morita ..... 347/86
6,419,341 B1 * 7/2002 Nohata et al. ..... 347/19

FOREIGN PATENT DOCUMENTS

JP 02001253630 A * 9/2001 ..... B41J/2/01

* cited by examiner

*Primary Examiner*—Stephen D. Meier
*Assistant Examiner*—An H. Do
(74) *Attorney, Agent, or Firm*—Staas & Halsey LLP

(57) ABSTRACT

A paper-discharging system of an inkjet printer includes a first roller part discharging a paper horizontally after the paper is printed by the printing head, an upward-guiding part guiding the printed paper to be upwardly bent at a first given angle after the printed paper is passed through the first roller part, and a second roller part bending the printed paper longitudinally at a second given angle and simultaneously discharging the printed paper after the printed paper is passed through the upward-guiding part. Accordingly, the paper-discharging system of the inkjet printer can provide a time period enough to dry ink on a pre-printed paper by controlling a printed paper to be stood straight by a stiffness of the paper itself until a rear end of the printed paper completely is passed through the second roller part, thereby preventing a damage, such as a smear, of printed letters or pictures of a previously printed paper due to an overlap between the printed paper and the previously printed paper.

37 Claims, 8 Drawing Sheets

PAPER-DISCHARGING SYSTEM AND METHOD IN AN INKJET PRINTER

CROSS-REFERENCE TO RELATED APPLICATIONS

This application claims the benefit of Korean Application No. 2001-68735, filed Nov. 6, 2001, in the Korean Industrial Property Office, the disclosure of which is incorporated hereby by reference.

BACKGROUND OF THE INVENTION

1. Field of the Invention

The present invention relates to a paper-discharging system and a method in an inkjet printer, and more particularly to, a paper-discharging system of an inkjet printer which can prevent damage of printed contents, such as a smear of incompletely dried pictures or letters, of previously printed paper due to an overlap with current printed paper when the current printed paper is discharged to a paper-discharging tray to be stacked on the previously printed paper.

2. Description of the Related Art

Generally, an inkjet printer 10 as shown in FIGS. 1 and 2 includes a paper feeder 20 containing paper P, a paper transporter 30 transporting the paper P from the paper feeder 20, a printing part 40 printing data on the paper P transported by the paper transporter 30, and a paper-discharging system 60 discharging the paper P printed by the printing part 40 to an outside of the inkjet printer 10.

In an operation of the inkjet printer 10, the paper P which is contained in the paper feeder 20 to be elastically supported by a lockup spring 21 is picked up by a pickup roller 22 and then moved to the paper transporter 30. At the paper transporter 30, the paper P is transported to the printing part 40 by a rotation of a feed roller 31 and a friction roller 32. Thus, when the paper P is transported from the paper transporter 30 to the printing part 40, a motor 45 driving a head carriage assembly is operated to drive a belt 43. Consequently, a printing head 41 which is mounted in a head carriage 46 of the head carriage assembly of the printing part 45 is moved left and right along a carriage shaft 42, ejecting ink on the paper P transported by the paper transporter 30 to print a picture or letters thereon. As the paper P is kept moving along a base frame 50 after printed by a nozzle 41*a* of the printing head 41, the paper P reaches the paper-discharging system 60. At the paper-discharging system 60, the paper P is discharged to the outside through paper-discharging rollers 61 and star-shaped wheels 62.

However, since the inkjet printer 10 uses a method of ejecting the ink on the paper P to print data thereon, it may produce damage of printed contents, such as a smear of printed images or letters, due to an overlap between previously printed paper and current printed paper when the current printed paper is dropped on the previously printed paper to be stacked thereon before the previously printed paper is completely dried. Accordingly, the inkjet printer 10 needs a vexing post-process of drying the ink of the respective printed paper for a given time period in every printing operation.

To solve the problem of producing the damage of printed contents and the vexing post-process, as shown in FIGS. 3A and 3B, there has been proposed another inkjet printer 10' using a method of disposing an elongated guide 63 in the vicinity of a paper-discharging opening or port. To prevent current printed paper P from being in contact with previously printed paper (not shown) already stacked on a paper-discharging tray 64, the inkjet printer 10' supports the current printed paper P at an inclined state on the guide 63 until next printed paper is discharged. The current printed paper P is dropped at the paper-discharging tray 64 by a pushing force generating when the next printed paper is discharged.

Thus, the inkjet printer 10' provides an advantage that prevents the smear of the printed letters or images of the previously printed paper when the current printed paper P is dropped on the previously printed paper at the paper-discharging tray 64 after the previous printed paper is almost dried. However, since the inkjet printer 10' has the elongated guide 63 which is longitudinally disposed in the paper-discharging tray 64, there was a problem that a volume of the inkjet printer 10' increases due to an increase of the elongated guide 63' in longitudinal and width directions thereof, thereby requiring a large space for the elongated guide 63.

SUMMARY OF THE INVENTION

Therefore, it is an object of the present invention to provide an improved paper-discharging system of an inkjet printer which can provide a time period enough to dry ink on previously printed paper by controlling current printed paper to be planar by a stiffness of the current printed paper itself until a rear end of the current printed paper is completely discharged to an outside of the inkjet printer, thereby preventing damage, such as a smear, of printed letters or pictures of the previously printed paper due to an overlap between the current printed paper and the previously printed paper.

Additional objects and advantageous of the invention will be set forth in part in the description which follows and, in part, will be obvious from the description, or may be learned by practice of the invention.

These and other objects may be achieved according to an embodiment of the present invention, by providing a paper-discharging system discharging paper printed by a printing head to an outside of an inkjet printer. The paper-discharging system includes a discharging unit discharging the printed paper upwardly and longitudinally bent from a discharging frame to ensure (control) the printed paper to be planar by a stiffness of the printed paper itself until a rear end of the printed paper is completely discharged to the outside. The discharging unit includes a first roller part discharging the paper horizontally after the printed paper has been printed by the printing head, an upward-guiding part guiding the printed paper to be upwardly bent at a first given (tilt) angle with the base frame after the printed paper is passed through the first roller part, and a second roller part bending the printed paper longitudinally at a second given (tilt) angle and discharging the printed paper after the printed paper is passed through the upward-guiding part.

The first roller part includes a shaft driven by a motor, a plurality of first paper-discharging rollers disposed at regular intervals on the shaft, and a plurality of first supporting rollers disposed over corresponding ones of the first paper-discharging rollers to transmit a rotation force of the first paper-discharging rollers to the printed paper.

The upward-guiding part includes at least one inclined plate having an inclined surface in which is gradually slanted to the upstream of a paper-discharging direction. Preferably, the tilt angle of the inclined surface is within the range of 10° through 60°. Alternatively, the upward-guiding part can include a plurality of inclined plates, each being disposed such that the first tilt angle of the inclined plates disposed at a center portion in width of the printed paper is smaller than that of the inclined plates disposed at a side portion in width of the printed paper.

The second roller part includes at least one small roller portion disposed to be tilted at the second given angle with a plane of the printed paper discharged through the upward-guiding part. The second tilt angle of the small roller portion is within the range of 5° through 30°. Also, the second roller part may have two small roller portions, each being disposed to be tilted at the second given angle upwardly from the horizontal plane of the printed paper discharged through the upward-guiding part with respect to the center in width of the printed paper. Each of the small roller portions includes a shaft tilted by the second given (tilt) angles with the printed paper discharged through the first roller part, second paper-discharging rollers disposed in regular intervals on the shaft, and second supporting rollers disposed respectively over the corresponding second paper-discharging rollers to transmit the rotation force of the second paper-discharging rollers to the printed paper.

The paper-discharging system includes a transmission transmitting the rotation force of the first roller part to the second roller part. The transmission includes a first gear formed at the first roller part, an idle gear engaged with the idle gear, and a universal joint transmitting the rotation force of the idle gear to the second roller part by being engaged with the idle gear. The universal joint includes a second gear engaged with the idle gear, T and ball-shaped ends formed respectively at the shafts of the small roller portions of the second roller part in the vicinity of the center in width of the printed paper, and a connecting part securing and interconnecting the T and ball-shaped ends at the second given angle to transmit the rotation force of the idle gear engaged with the second gear to the shafts of the small roller portions tilted at the second given angle.

Alternatively, the transmission may have a first gear formed at one end of the first roller part, an idle gear engaged with the first gear, and a second gear engaged with the idle gear transmitting the rotation force of the idle gear to one of the small roller portions of the second roller part. In this case, an universal joint is disposed between the small roller portions transmitting the rotation force from one to the other of the small roller portions. The universal joint includes T and ball-shaped ends formed respectively at the shafts of the small roller portions of the second roller part in the vicinity of the center portion in the widthwise direction of the printed paper, and the connecting part secures and interconnects the T and ball-shaped ends at the second given angle to transmit the rotation force from one to the other of the shafts of the small roller portions tilted at the second given angle.

BRIEF DESCRIPTION OF THE DRAWINGS

These and other objects and advantageous of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
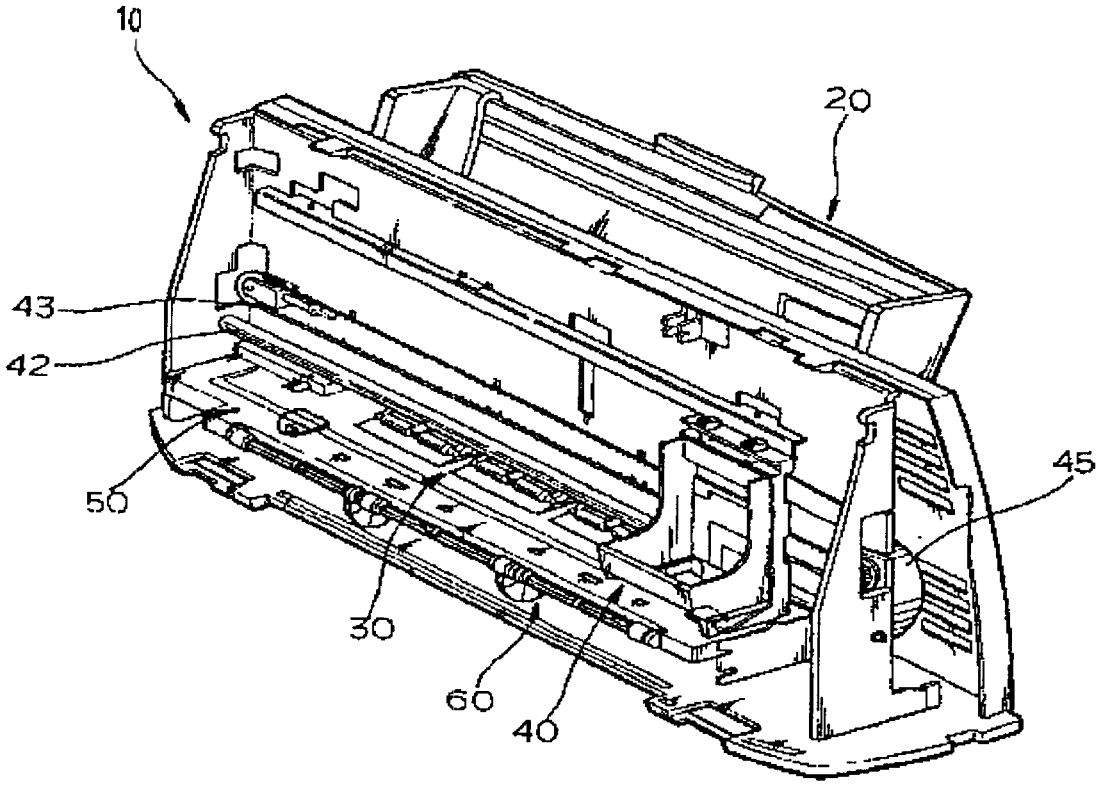
FIG. 1 (PRIOR ART)
FIG. 1 is a partial perspective view of a conventional inkjet printer.
Figure 2:
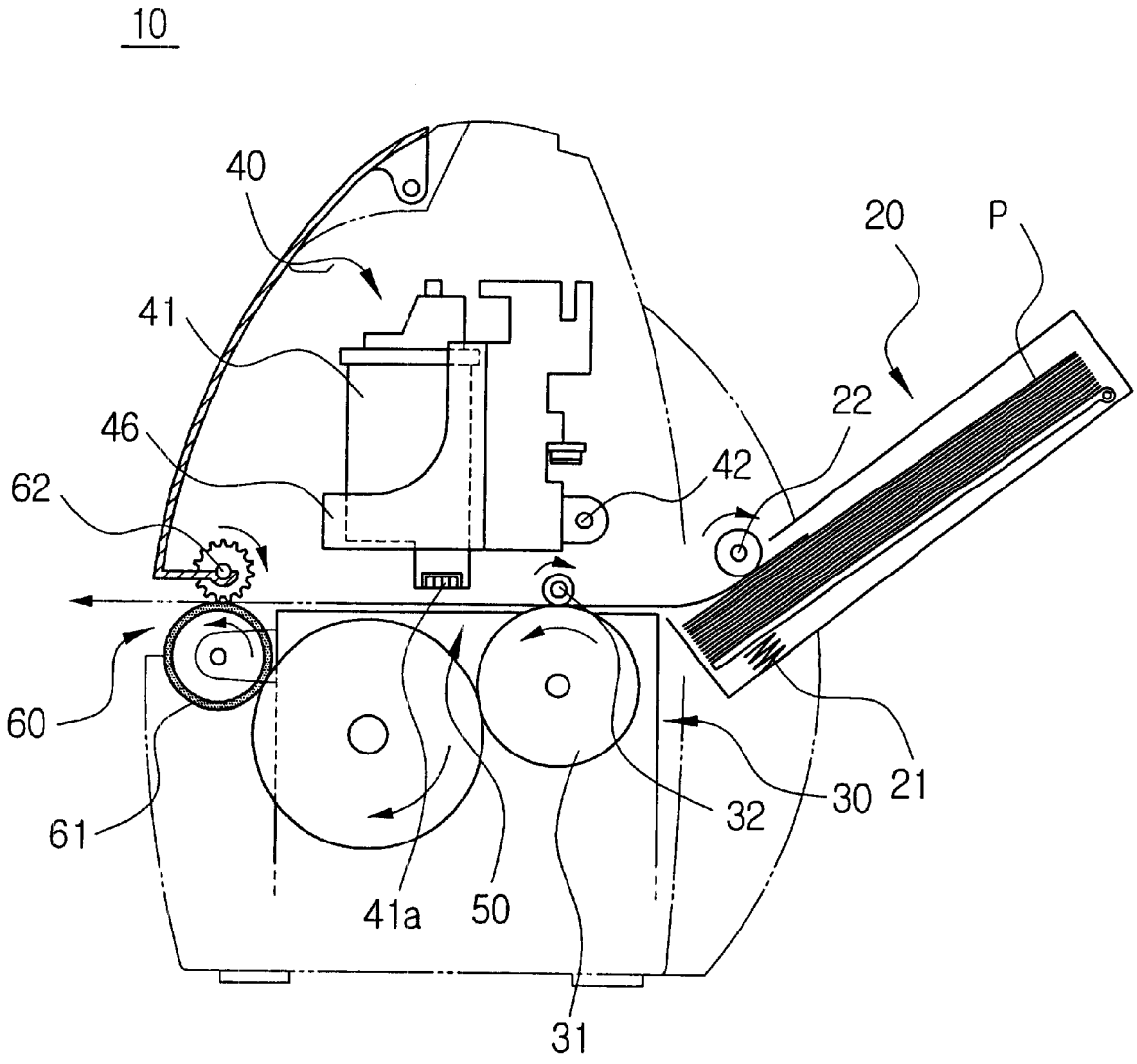
FIG.2 (PRIOR ART)
FIG. 2 is a partial cross-sectional view of the inkjet printer shown in FIG. 1.
Figure 3A:
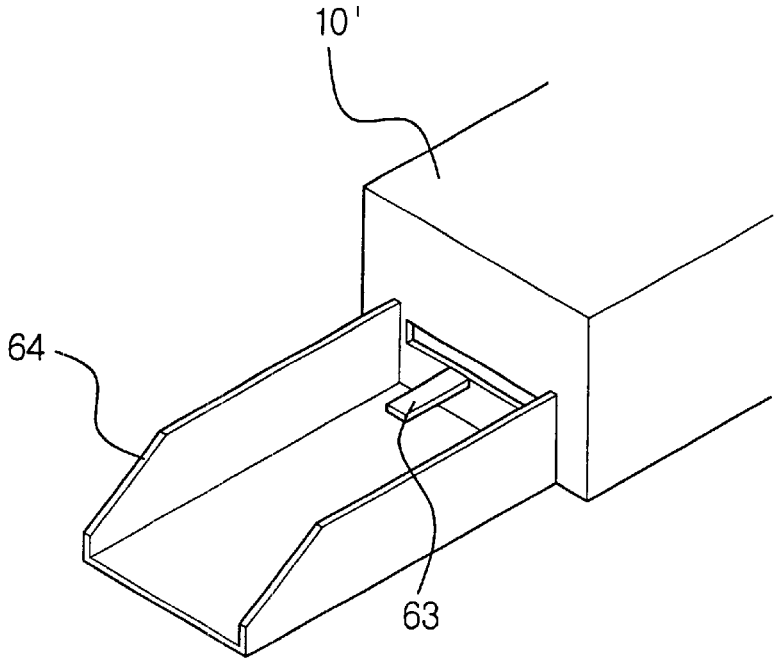
FIG.3A (PRIOR ART)
FIG. 3A and FIG. 3B are perspective views of a paper-discharging tray of another conventional inkjet printer.
Figure 3B:
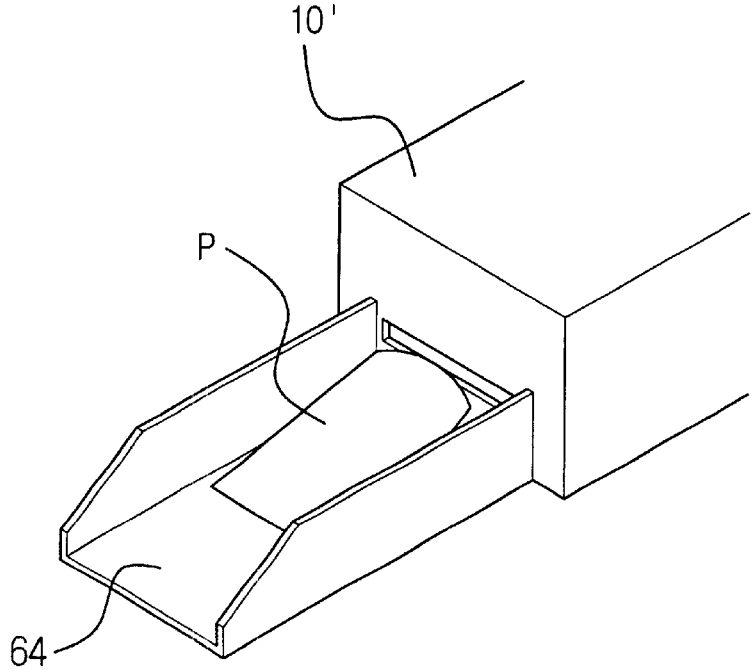
FIG.3B (PRIOR ART)

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

Figure 4:
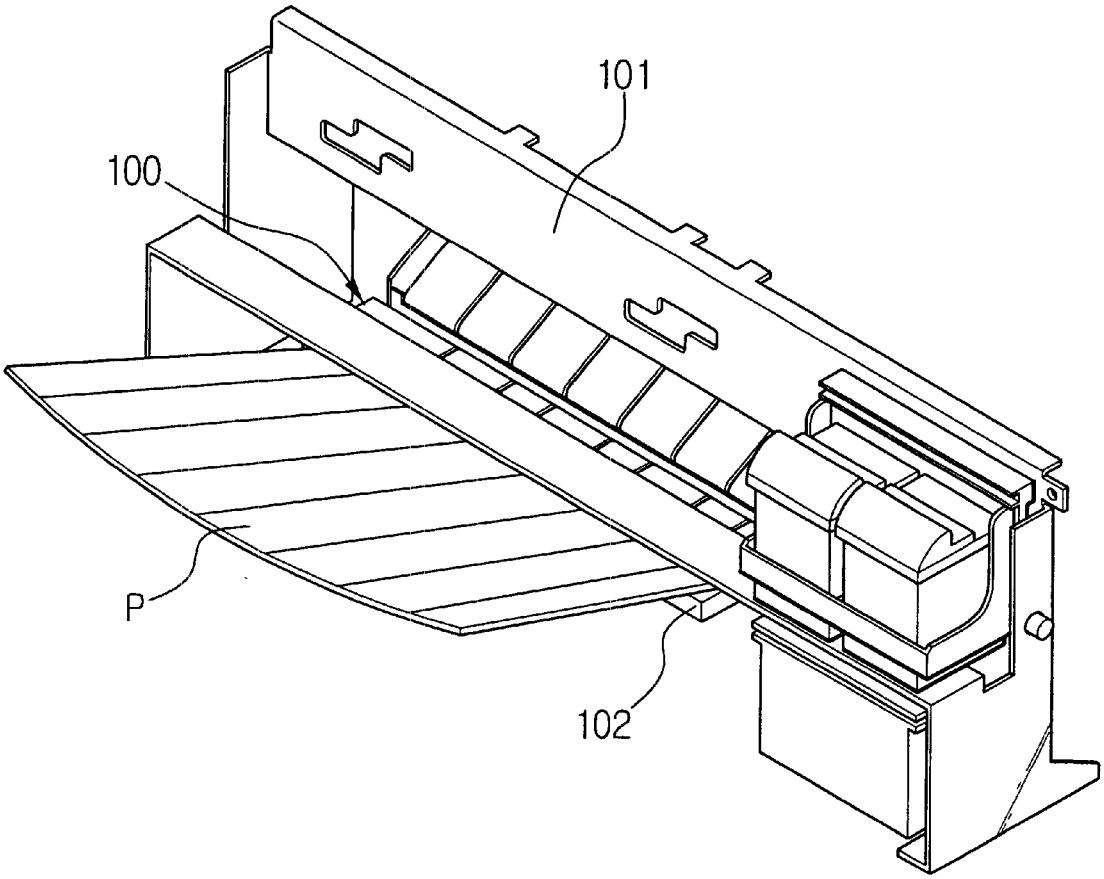
FIG. 4 is a perspective view of a main frame of an inkjet printer to which a paper-discharging system in accordance with an embodiment of the present invention is applied.
Figure 5:
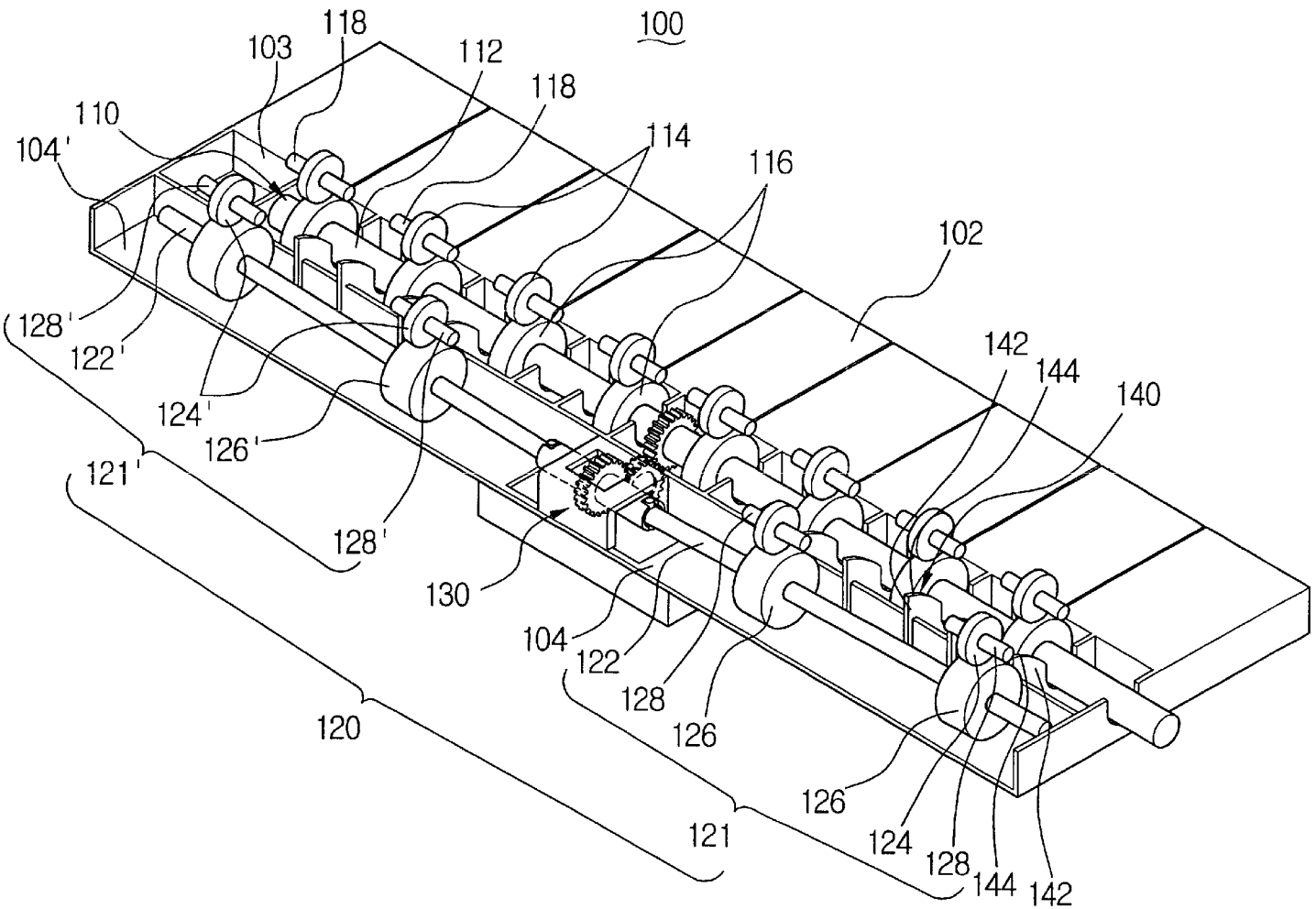
FIG. 5 is a perspective view of the paper-discharging system shown in FIG. 4.

Referring now to FIGS. 4 and 5, there is illustrated a paper-discharging system 100 in accordance with an embodiment of the present invention, which is incorporated into a base frame 101 and a discharging frame 102.

As shown in FIG. 5, the paper-discharging system 100 includes a first roller part 110 discharging paper P horizontally in a feeding direction after the paper P is printed by a printing head (not shown), and an upward-guiding part 140 guiding the printed paper P to be upwardly bent in a lengthwise direction at a first given (tilt) angle θ (FIG. 7) with the discharging frame 102 after the printed paper P is passed through the first roller part 110 while discharging the printed paper in a first discharging direction. The paper-discharging system 100 also includes a second roller part 120 bending the printed paper P in a widthwise direction at a second given (tilt) angle δ (FIG. 6) with a plane formed by the printed paper P and simultaneously discharging the printed paper P to an outside of the paper-discharging system 100 in a second discharging direction after the printed paper P is passed through the upward-guiding part 140 along the first discharging direction.

The first roller part 110 includes a first shaft 112 connected to a gear (not shown) which is rotated at a given speed by a motor (not shown), a plurality of first paper-discharging rollers 116 disposed at regular intervals on the first shaft 112, and a plurality of first supporting rollers 114 disposed to face corresponding ones of the first paper-discharging rollers 116 to transmit a rotation force of the first paper-discharging rollers 116 to the printed paper P. The first shaft 112 with the first paper-discharging rollers 116 is disposed in a first recess 103 which is transversely formed in the discharging frame 102. The printed paper P is transferred through the discharging frame 102 to the first roller part 110. The first supporting rollers 114 are positioned over the corresponding ones of the first paper-discharging rollers 116 by a plurality of second shafts 118. The second shafts 118 are rotatably disposed in regular intervals in a shaft holder (not shown) which is fixed in the discharging frame 102. Accordingly, when the first shaft 112 is rotated by the gear of the motor, the first paper-discharging rollers 116 together with the first supporting rollers 114 discharge the printed paper P in a horizontal or feeding direction.

Figure 7:
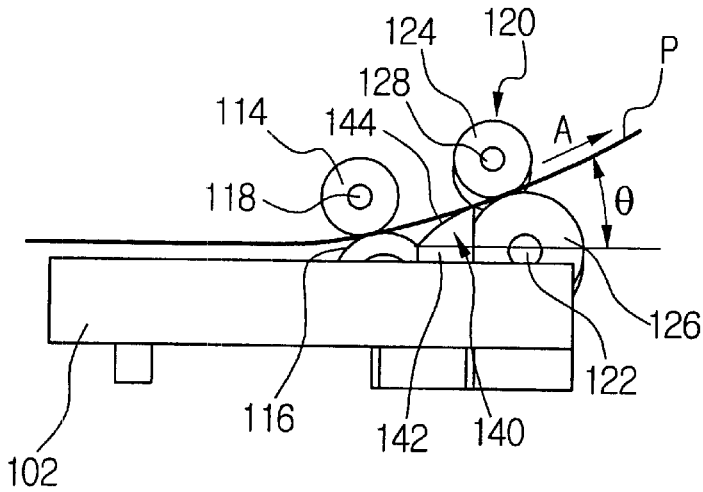
FIG. 7 is a side view of the paper-discharging system shown in FIG. 5.

The upward-guiding part 140 includes a plurality of inclined plates 142. The inclined plates 142 are arranged such that each pair thereof is projected upward from the discharging frame 102 between the first paper-discharging rollers 116 and is positioned at both sides except for a center portion of the discharging frame 102. As shown in FIGS. 5 and 7, each of the inclined plates 142 has an inclined surface 144 which gradually slants to the upstream of a paper-discharging direction to ensure the printed paper P to be bent and guided upwardly in the first discharging direction after the printed paper P is passed through the first roller part 110. Preferably, the first given (tilt or inclined) angle Θ of the inclined surface 144 inclined with respect to the discharging frame 102 is within the range of 10° through 60°.

In FIG. 7, a first line perpendicularly passing through longitudinal centers of the first shaft 112' and the second shaft 118 may have a predetermined angle with the discharging frame 102. A second line perpendicularly passing through longitudinal centers of the third shaft 122, 122' and the fourth shaft 128, 128' may have a second predetermined angle with the discharging frame 102 or the feeding direction. The second line is not perpendicular to the plane of the printed paper P passing over the upward guiding part 140.

Alternatively, in the drawings, all the inclined plates 142 are illustrated as having the same first tilt angle, but the inclined plates 142 can be formed such that the tilt angle of the inclined plates 142 disposed at a center portion of the discharging frame 102 is smaller than that of the inclined plates 142 disposed at a side portion of the discharging frame 102 to allow the printed paper P to be easily bent in the first discharging direction by the second roller part 120 as will be described below.

The second roller part 120 includes the two small roller portions 121, 121', each of which is connected to a universal joint 136 (FIG. 8) of a transmission 130 disposed at a center in width of the printed paper P as will be described below. As shown in FIG. 5, each of the small roller portions 121, 121' has a third shaft 122 or 122', second paper-discharging rollers 126 or 126' disposed in regular intervals on the third shaft 122 or 122', and second supporting rollers 124 or 124' disposed over corresponding ones of the second paper-discharging rollers 126, 126' to transmit a rotation force of the second paper-discharging rollers 126, 126' to the printed paper P. The third shafts 122, 122' together with the second paper-discharging rollers 126, 126' are transversely disposed in second recesses 104, 104' formed at the discharging frame 102, respectively. The second supporting rollers 124, 124' are disposed over the corresponding ones of the second paper-discharging rollers 126, 126' by fourth shafts 128, 128'. The fourth shafts 128, 128' are disposed in a shaft holder (not shown) which is fixed in the discharging frame 102.

The printed paper P guided through the upward-guiding part 140 forms the first given angle θ with the discharging frame 102. The first roller part 110 is disposed to transfer the printed paper P toward the upward guiding part 140. Since the inclined plates 142 of the upward guiding part 140 are oblique to the discharging frame 102, the second roller part 120 is disposed to receive the printed paper from the first roller part 110 through the upward guiding part 140. The small roller portion 121, 121' of the second roller part 120 is disposed to be oblique to the plane in the widthwise direction at the second given angle δ with the printed paper P discharged from the first roller part 110 through the upward guiding part 140. Therefore, a side portion of the printed paper P in the widthwise direction is bent with respect to a center portion of the printed paper P at the second given angle with the plane of the printed paper P while being discharged in the second discharging direction.

Figure 6:
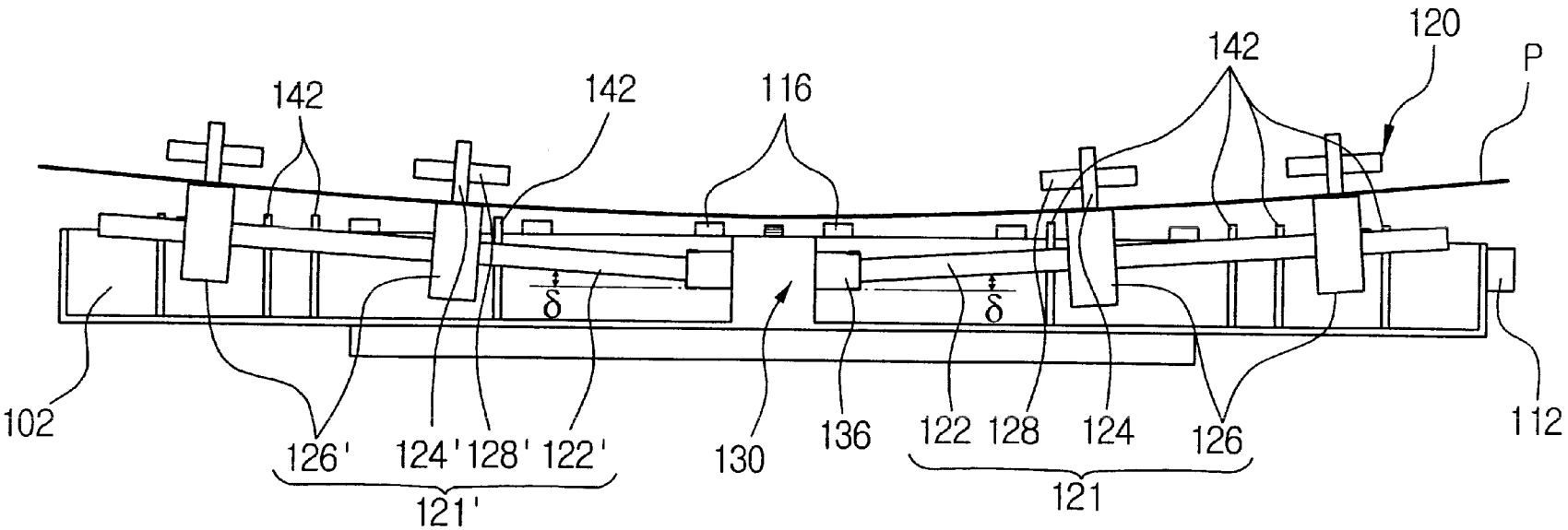
FIG. 6 is a front view of the paper-discharging system shown in FIG. 5.

As shown in FIG. 6, in order to bend the printed paper P longitudinally and in the widthwise direction to be stood straight by a stiffness of the paper itself until a rear end of the printed paper P is completely discharged to the outside, each of the small roller portions 121, 121' is disposed to be tilted at the second given angle upwardly from the plane of the printed paper P at a center portion of the widthwise direction thereof. At this time, preferably, the second tilt angle of the small roller portions 121, 121' with the plane is within the range of 5° through 30°.

Also, when the motor is used as a source driving the second roller part 120 without using a separate motor, the rotation force of the motor is transmitted to the second part 120 through the first roller part 110. The paper-discharging system 100 includes a transmission 130 transmitting a rotation force of the first roller part 110 to the second roller part 120. The transmission 130 is disposed at the center portion in the widthwise direction of the printed paper P to transmit the rotation force of the first roller part 110 to the small roller portions 121, 121' of the second roller part 120.

Figure 8:
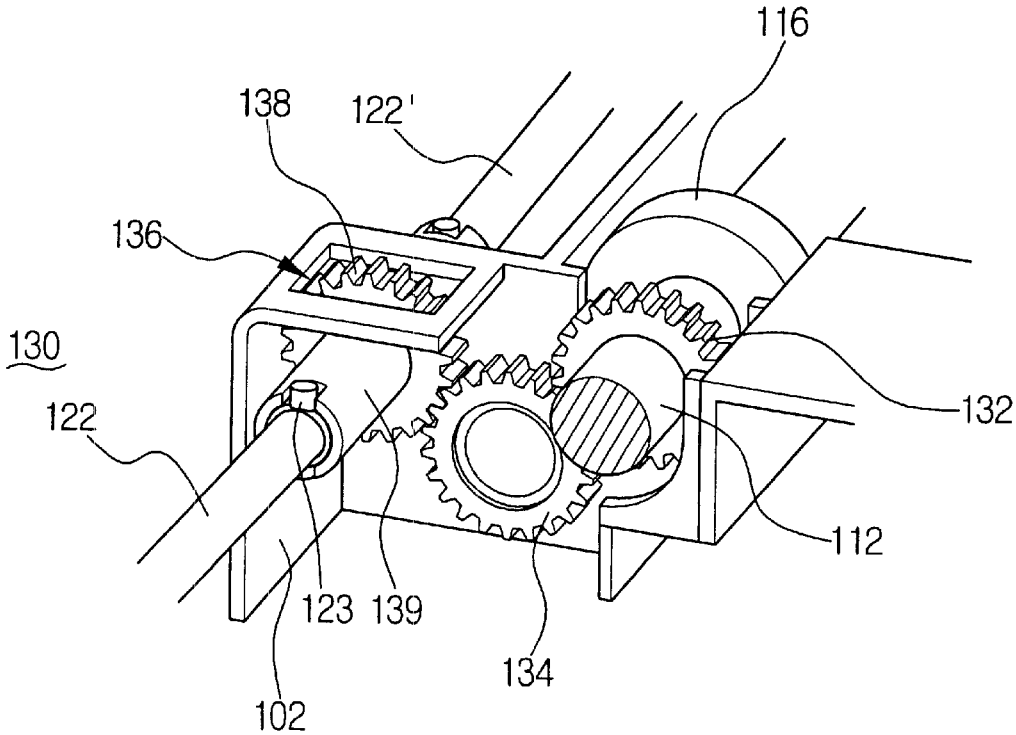
FIG. 8 is a perspective view of a transmission of the paper-discharging system shown in FIG. 5.

As shown in FIG. 8, the transmission 130 has a first gear 132 formed at the first shaft 112 of the first roller part 110, an idle gear 134 disposed at the frame 102 to engage with the first gear 132, and a universal joint 136 to transmit a rotation force of the idle gear 134 to the third shafts 122, 122' of the small roller portions 121, 121' of the second roller part 120 by being engaged with the idle gear 134. In order to transmit the rotation force tilted at the second given angle, the universal joint 136 has a second gear 138 engaged with the idle gear 134, T and ball-shaped ends 123 formed respectively at ends of the third shafts 122, 122' of the small roller portions 121, 121' of the second roller part 120 in the vicinity of the center of the frame 102, i.e., the center in width of the printed paper P, and a coupling part 139 securing and interconnecting the T and ball-shaped ends 123 at the second given angle to transmit the rotation force of the idle gear 134 engaged with the second gear 138 to the third shafts 122, 122' of the small roller portions 121, 121' tilted at the second given angle.

As described above, the paper-discharging system 100 of the inkjet printer in accordance with the embodiment of the present invention can provide a time period sufficient enough to dry the ink of pre-printed paper (not shown) by ensuring (controlling) the current printed paper P to be planar by the stiffness of the paper itself until the rear end of the current printed paper P is completely dropped in a paper-discharging tray (not shown) through the upward-guiding part 140 and the second roller part 120, thereby preventing damage, such as a smear, of printed contents of the previously printed paper P.

An operation of a paper-discharging system 100 of an inkjet printer in accordance with the embodiment of the present invention will now be explained with reference to FIGS. 4 through 8.

First, the printing paper P in which data are printed by the nozzle of the printing head ejecting ink is gradually moved to the first roller part 110 by a paper-feeder. After arriving at the first roller part 110, the printed paper P is horizontally transported through a gap between the first supporting rollers 114 and the first paper-discharging rollers 116 by the first paper-discharging rollers 116. At this time, the first paper-discharging rollers 116 are clockwise rotated according to an operation of motor connected to the gear of the first shaft 112.

Thereafter, as shown in FIG. 7, the printed paper P is moved in an arrow direction A by the first paper-discharging rollers 116 and then reaches the upward-guiding part 140. At the upward-guiding part 140, the printed paper P is guided to be moved upwards toward the second roller part 120 by bending through the inclined surfaces 144 of the inclined plates 142 of the upward-guiding part 140. As shown in FIG. 4 and FIG. 6, as the printed paper P is kept moving upward after arriving at the second roller part 120, it is longitudinally bent in relation to a center in width thereof by the small roller portions 121, 121' which receives a clockwise rotation force through the first gear 132, the idle gear 134 and the universal joint 136 from the first shaft 112.

At this time, since the printed paper P is upwardly and longitudinally bent, it is maintained to be planar by a stiffness of the paper itself without being bent downward until a rear end of the printed paper P completely is passed through the second roller part 120. Accordingly, the previously printed paper, which is already discharged to the paper-discharging tray, can be given a time period sufficient enough to dry ink ejected therein while the printed paper P is maintained to be planar, i.e., until it is completely passed through the second roller part 120.

Thus, when the printed paper P is kept moving and then completely passes through the second roller part 120, the printing paper P drops in the discharging tray to be stacked therein.

Figure 9:
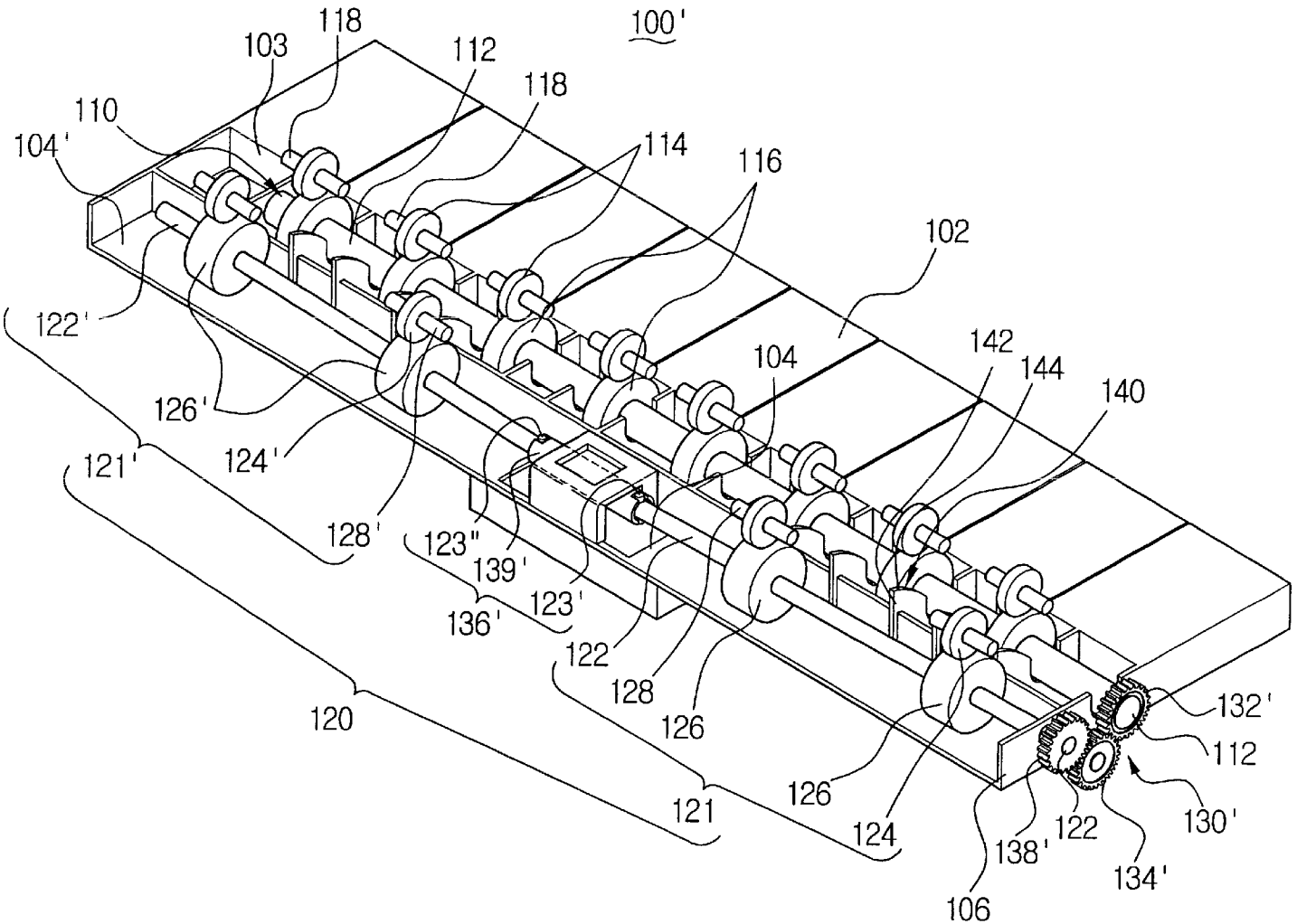
FIG. 9 is a perspective view of a second paper-discharging system of an inkjet printer in accordance with another embodiment of the present invention.

Referring to FIG. 9, there is illustrated a second paper-discharging system 100' of an inkjet printer in accordance with another embodiment of the present invention.

The second paper-discharging system 100' has the same structure as that of the paper-discharging system 100 of the first embodiment of FIG. 5 except that a second transmission 130' transmitting the rotation force of the first roller part 110 is disposed at one side of the discharging frame 102, and a fourth gear. 138', which is to be formed on a second coupling part 139' in the paper-discharging system 100 of FIG. 5, is disposed on an end of a third shaft 122 of one small roller portion 121 of the second roller part 120 rotatably coupled to the one side of the discharging frame 102 to be tilted at the second given angle upwardly from a horizontal plane of the printed paper.

The second transmission 130' is disposed at the one side of the discharging frame 102, i.e., one side edge in width of the printed paper such that it can transmit the rotation force received from the motor driving the first roller part 110 through a separate gear (not shown) to the end of the third shaft 122 of the small roller portion 121 of the second roller part 120.

As shown in FIG. 9, the second transmission 130' has a third gear 132' formed at an end of the first shaft 112 of the first roller part 110 which is positioned toward one side of the discharging frame 102, a second idle gear 134' rotatably disposed at a side plate 106 of the discharging frame 102 to be engaged with the third gear 132', and the fourth gear 138' formed on the end of the third shaft 122 to be engaged with the second idle gear 134' and thereby transmit the rotation force of the second idle gear 134' to the third shaft 122 of the small roller portion 121.

In order to transmit the rotation force from one to the other of third shafts 122, 122' of the two small roller portions 121, 121', each of which is disposed to be tilted at the second given angle, a second universal joint 136' is disposed therebetween. The second universal joint 136' includes two second T and ball-shaped ends 123', 123", each of which is formed at the third shafts 122, 122' of the small roller portions 121, 121' in the vicinity of a center of the discharging frame 102. i.e., a center in width of the printed paper, and a second coupling part 139' securing and interconnecting the T and ball-shaped ends 123', 123" at the second given angle to transmit the rotation force from one to the other of the third shafts 122, 122' of the small roller portions 121.

Thus, the rotation force transmitted from the motor driving the first roller part 110 through the separate gearing can be transmitted to the third shaft 122 of the small roller portion 121 through the third gear 132', the second idle gear 134' and the fourth gear 138', and then to the third shaft 122' of the small roller portion 121' through the second universal joint 136'.

The operation of the paper-discharging system 100' of the inkjet printer in accordance with the second embodiment will not be explained in detail since it is the same as that of the paper-discharging system 100 except the process of transmitting the rotation force of the motor from the first roller part 110 through the third gear 132' of the second transmission 130' to the small roller portions 121, 121' of the second roller part 120.

As is apparent from the foregoing description, it can be appreciated that the paper-discharging systems in accordance with the preferred embodiments of the present invention can provide the time sufficient enough to dry the ink in the previously printed paper by ensuring that the current printed paper is planar by the stiffness of the current printed paper itself until the rear end of the current printed paper is completely passed through the second roller part, thereby preventing the damage such as the smear of printed letters or pictures from being generated in the previously printed paper due to overlapping between the current printed paper and the previously printed paper.

Although a few preferred embodiments of the present invention have been shown and described, it would be appreciated by those skilled in the art that changes may be made in this embodiment without departing from the principles and sprit of the invention, the scope of which is defined in the claims and their equivalents.

What is claimed is:

1. A paper-discharging system for discharging paper printed by a printing head to an outside of an inkjet printer having rollers picking up and feeding the paper toward the printing head, the paper-discharging system comprising:

a discharging unit disposed between the printing head and the outside to receive the printed paper from the printing heal to control the printed paper to be upwardly and longitudinally bent with respect a feeding direction of the printed paper and to be bent in a discharging direction and a widthwise direction perpendicular to the discharging direction so that a portion of the printed paper disposed outside of the printer is planar by a stiffness of the paper itself until a rear end of the printed paper is completely discharged to the outside.

2. The system according to claim 1, wherein the discharging unit comprises:

a first roller part discharging the printed paper in the feeding direction after the paper is printed by the printing head;

an upward-guiding part guiding the printed paper to be upwardly bent in a first discharging direction at a first given angle with the feeding direction after the printed paper is passed through the first roller part; and a second roller part controlling the printed paper to be bent in the widthwise direction at a second given angle with a plane of the printed paper passing through the upward-guiding part while simultaneously discharging the printed paper in a second discharging direction after the printed paper is passed through the upward-guiding part.

3. The system according to claim 2, wherein the first roller part comprises:

a motor;

a shaft driven by the motor;

a plurality of first paper-discharging rollers disposed at regular intervals on the shaft; and a plurality of first supporting rollers disposed over corresponding ones of the first discharging rollers to transmit a rotation force of the first discharging rollers to the printed paper.

4. The system according to claim 2, wherein the upward-guiding part comprises:

at least one inclined plate having an inclined surface which gradually slants to the upstream of the feeding direction.

5. The system according to claim 2, wherein the second roller part comprises:

at least one small roller portion disposed in the widthwise direction to be tilted at the second given angle with the plane of the printed paper discharged through the upward-guiding part.

6. The system according to claim 2, wherein the second roller part includes two small roller portions each being disposed to be tilted at the second given angle upwardly from the plane of the printed paper discharged through the upward guiding part.

7. A paper-discharging system for discharging paper printed by a printing head to an outside of an inkjet printer, comprising:

a discharging unit controlling the printed paper to be upwardly and longitudinally bent with respect a feeding direction of the printed paper to be planar by a stiffness of the paper itself until a rear end of the printed paper is completely discharged to the outside, the discharging unit comprises, a first roller part discharging the printed paper in the feeding direction after the paper is printed by the printing head, an upward-guiding pert guiding the printed paper to be upwardly bent in a first discharging direction at a first given angle with the feeding direction after the printed paper is passed through the first roller part, and a second roller part controlling the printed paper to be bent in a widthwise direction at a second given angle with a plane of the printed paper passing through the upward-guiding part while simultaneously discharging the printed paper in a second discharging direction after the printed paper is passed through the upward-guiding part;

wherein the upward-guiding part comprises at least one inclined plate having an inclined surface which gradually slants to the upstream of the feeding direction, and the inclined surface is inclined at the first given angle within the range of 10° through 60°.

8. A paper-discharging system for discharging paper printed by a printing head to an outside of an inkjet printer, comprising:

a discharging unit controlling the printed paper to be upwardly and longitudinally bent with respect a feeding direction of the printed paper to be planar by a stiffness of the paper itself until a rear end of the printed paper is completely discharged to the outside, the discharging unit comprises, a first roller part discharging the printed paper in the feeding direction after the paper is printed by the printing head, an upward-guiding part guiding the printed paper to be upwardly bent in a first discharging direction at a first given angle with the feeding direction after the printed paper is passed through the first roller part, and a second roller part controlling the printed paper to be bent in a widthwise direction at a second given angle with a plane of the printed paper passing through the upward-guiding part while simultaneously discharging the printed paper in a second discharging direction after the printed paper is passed through the upward-guiding part;

wherein the upward-guiding part includes a plurality of inclined plates each being disposed such that the first given angle of inclined plates disposed at a center portion in the widthwise direction of the printed paper is smaller than that of the inclined plates disposed at a side portion in the widthwise direction of the printed paper.

9. A paper-discharging system for discharging paper printed by a printing head to an outside of an inkjet printer, comprising:

a discharging unit controlling the printed paper to be upwardly and longitudinally bent with respect a feeding direction of the printed paper to be planar by a stiffness of the paper itself until a rear end of the printed paper is completely discharged to the outside, the discharging unit comprises, a first roller part discharging the printed paper in the feeding direction after the paper is printed by the printing head, an upward-guiding part guiding the printed paper to be upwardly bent in a first discharging direction at a first given angle with the feeding direction after the printed paper is passed through the first roller part, and a second roller part controlling the printed paper to be bent in a widthwise direction at a second given angle with a plane of the printed paper passing through the upward-guiding part while simultaneously discharging the printed paper in a second discharging direction after the printed paper is passed through the upward-guiding part;

wherein the second roller part includes two small roller portions each being disposed to be tilted at the second given angle upwardly from the plane of the printed paper discharged through the upward guiding part, and the small roller portions are inclined at the second given angle within the range of 5° through 30°.

10. A paper-discharging system for discharging paper printed by a printing head to an outside of an inkjet printer, comprising:

a discharging unit controlling the printed paper to be upwardly and longitudinally bent with respect a feeding direction of the printed paper to be planar by a stiffness of the paper itself until a rear end of the printed paper is completely discharged to the outside, the discharging unit comprises, a first roller part discharging the printed paper in the feeding direction after the paper is printed by the printing head, an upward-guiding port guiding the printed paper to be upwardly bent in a first discharging direction at a first given angle with the feeding direction after the printed paper is passed through the first roller part, and a second roller part controlling the printed paper to be bent in a widthwise direction at a second given angle with a plane of the printed paper passing through the upward-guiding part while simultaneously discharging the printed paper in a second discharging direction after the printed paper is passed through the upward-guiding part;

wherein the second roller part includes two small roller portions, and each of the small roller portions comprises, a shaft disposed in the widthwise direction to have the second given angle with the plane, and second paper-discharging rollers disposed in regular intervals on the shaft; and second supporting rollers disposed respectively over the corresponding second discharging rollers to transmit a rotation force of the second discharging rollers to the printed paper.

11. The system according to claim 10, wherein the discharging unit comprises:

a transmission transmitting the rotation force of the first roller part to the second roller part.

12. The system according to claim 11, wherein the transmission comprises:

a first gear formed at the first roller part;

an idle gear engaged with the first gear; and a universal joint transmitting the rotation force of the idle gear to the second roller part by being engaged with the idle gear.

13. The system according to claim 12, wherein the universal joint comprises:

a second gear engaged with the idle gear;

T and ball-shaped ends formed at respective shafts of the small roller portions of the second roller part in the vicinity of the center in width of the printed paper; and a coupling part securing and interconnecting the T and ball-shaped ends at the second given angle to transmit the rotation force of the idle gear engaged through the second gear to the respective shafts of the small roller portions tilted at the second given angle.

14. The system according to claim 11, wherein the transmission comprises:

a first gear formed at one end of the first roller part;

an idle gear engaged with the first gear; and a second gear being engaged with the idle gear to transmit the rotation force of the idle gear to one of the small roller portions of the second roller part.

15. The system according to claim 14, wherein the discharging unit comprises:

a universal joint disposed between the small roller portions of the second roller part to transmit the rotation force from one to another of the small roller portions.

16. The system according to claim 15, wherein the universal joint comprises:

T and ball-shaped ends formed at respective shafts of the small roller portions of the second roller part in the vicinity of the center in width of the printed paper; and a coupling part securing and interconnecting the T and ball-shaped ends at the second given angle to transmit the rotation force from one to the other of the shafts of the small roller portions tilted at the second given angle.

17. An apparatus in an inkjet printer having a printing head printing paper and discharging the printed paper in a discharging tray along a discharging frame and having rollers picking up and feeding the paper toward the printing head, the paper-discharging system comprising:

a discharging unit disposed between the printing head and the discharging tray to receive the printed paper from the printing head to control the printed paper to be bent in a lengthwise direction of the printed paper at a first angle with the discharging frame and in a widthwise direction, which is perpendicular to the lengthwise direction, of the printed paper at a second angle with the discharge frame.

18. The apparatus of claim 17, wherein the discharging unit controls the printed paper so that a portion of the printed paper disposed outside the inkjet printer is planar upwardly in the discharging direction by a stiffness of the paper itself while discharging the printed paper in the discharging direction parallel to the lengthwise direction.

19. The apparatus of claim 17, wherein the discharging unit comprises:

a first roller part feeding the printed paper in a feeding direction;

a guiding part guiding the printed paper to be bent in the lengthwise direction having the first angle with the feeding direction; and a second roller part bending the bent printed paper in the widthwise direction having the second angle with the lengthwise direction.

20. The apparatus of claim 19, wherein the second roller part controls the bent printed paper so that a portion of the printed paper disposed outside the inkjet printer is planar upwardly in the discharging direction by a stiffness of the paper itself while discharging the printed paper in the discharging direction parallel to the lengthwise direction.

21. The apparatus of claim 19, wherein the first roller part comprises a feeding shaft having a feeding roller, and the second roller part comprises a discharging shaft having a discharging roller and being not parallel to the feeding shaft.

22. The apparatus of claim 21, wherein the discharging shaft forms the second angle with the feeding shaft.

23. The apparatus of claim 19, wherein the first roller part comprises:

a first discharging shaft having a first discharging roller; and a first supporting shaft having a first supporting roller disposed to contact the first discharging roller and feed the printed paper with the first discharging roller, wherein a first line perpendicularly passing through centers of the first discharging shaft and the first supporting shaft forms a third angle with the feeding direction.

24. The apparatus of claim 19, wherein the discharging unit comprises a single motor driving both the first roller part and the second roller part.

25. The apparatus of claim 19, wherein the discharging unit comprises a transmission disposed between the first roller part and the second roller part to transmit a rotation force from the first roller part to the second roller part.

26. An apparatus in an inkjet printer having a printing head printing paper and discharging the printed paper in a discharging tray along a discharging frame, comprising:

a discharging unit controlling the printed paper to be bent in a lengthwise direction of the printed paper at a first angle with the printed paper and in a widthwise direction of the printed paper at a second angle with the printed paper, the discharging unit including a first roller part feeding the printed paper in a feeding direction, a guiding part guiding the printed paper to be bent in the lengthwise direction having the first angle with the feeding direction, and a second roller part bending the bent printed paper in the widthwise direction having the second angle with the lengthwise direction, the first roller part including a first discharging shaft having a first discharging roller, and a first supporting shaft having a first supporting roller disposed to contact the first discharging roller and feed the printed paper with the first discharging roller, wherein a first line perpendicularly passing through centers of the first discharging shaft and the first supporting shaft forms a third angle with the feeding direction;

wherein the second roller part comprises, a second discharging shaft having a second discharging roller, and a second supporting shaft having a second supporting roller disposed to contact the second discharging roller and teed the printed paper with the second discharging roller, wherein a second line perpendicularly passing through centers of the second discharging shaft and the second supporting shaft forms a fourth angle with the feeding direction.

27. The apparatus of claim 26, wherein the first line of the first roller part is parallel to the second line of the second roller part.

28. The apparatus of claim 26, wherein the third angle is different from the fourth angle.

29. An apparatus in an inkjet printer having a printing head printing paper and discharging the printed paper in a discharging tray along a discharging frame, comprising:

a discharging unit controlling the printed paper to be bent in a lengthwise direction of the printed paper at a first angle with the printed paper and in a widthwise direction of the printed paper at a second angle with the printed paper, the discharging unit including a first roller part feeding the printed paper in a feeding direction, a guiding part guiding the printed paper to be bent in the lengthwise direction having the first angle with the feeding direction, and a second roller part bending the bent printed paper in the widthwise direction having the second angle with the lengthwise direction;

wherein the discharging unit comprises a first recess and a second recess both formed on the discharging frame and separated by a plate, and the first roller part is disposed in the first recess, the second roller part disposed in the second recess.

30. The apparatus of claim 29, wherein the plate comprises a slit, and the guiding part is disposed in the slit in the feeding direction.

31. The apparatus of claim 29, wherein the plate comprises a first slit and a second slit formed on both sided of the plate, and the guiding part having a first inclined plate and a second guiding plate disposed in corresponding ones of the first slit and the second slit.

32. The apparatus of claim of claim 29, wherein the discharging unit comprises a transmission disposed in the second recess to transmit a rotation force from the first roller part to the second roller part.

33. An apparatus in an inkjet printer having a printing head printing paper and discharging the printed paper in a discharging tray in a discharging direction and having rollers picking up and feeding the paper toward the printing head, the apparatus comprising:

a discharging unit disposed between the printing head and the discharging tray to receive the printed paper from the printing head, and controlling printed paper to be bent in a lengthwise direction of the printed paper and a widthwise direction perpendicular to the lengthwise direction so that a portion of the printed paper disposed an outside of the printer in the discharging direction is maintained planar by the stiffness of the printed paper itself until a rear end of the printed paper is completely passed through the discharging unit to provide a time period sufficient enough to dry ink in previously discharged printed paper before the printed paper is overlapped with the previously discharged printed paper to prevent a smear of a printed letter or picture due to an overlap between the printed paper and the previously discharged printed paper.

34. A method in an inkjet printer discharging printed paper, the method comprising:

causing a discharging unit to be disposed between a printing head and a discharging tray to receive the printed paper from the printing head; and controlling the printed paper to be bent in a lengthwise direction of the printed paper and a widthwise direction perpendicular to the lengthwise direction so that a portion of the printed paper disposed outside of the printer in the discharging direction is maintained planar by the stiffness of the printed paper itself until a rear end of the printed paper is completely passed through the discharging unit to provide a time period sufficient enough to dry ink in previously discharged printed paper before the printed paper is overlapped with the previously discharged printed paper to prevent a smear of a printed letter or picture due to an overlap between the printed paper and the previously discharged printed paper.

35. The method of claim 34, wherein the inkjet printer comprises a first roller part feeding printed paper in a feeding direction, a guiding part guiding the fed printed paper, and a second roller part bending the guided printed paper, the method comprises:

bending the printed paper fed from the first roller part in the lengthwise direction having a first angle with the printed paper fed from the first roller part; and bending the lengthwise bent printed paper in the widthwise direction having a second angle with the lengthwise bent printed paper.

36. The method of claim 34, the bending of the printed paper comprises:

discharging the printed paper toward the second roller part during bending the printed paper fed from the first roller part in the lengthwise direction.

37. The method of claim 34, the bending of the lengthwise bent printed paper comprises:

discharging the lengthwise bent printed paper toward an outside of the inkjet printer during the bending the lengthwise bent printed paper in the widthwise direction.

* * * * *